US005775984A

United States Patent [19]

Olson et al.

[11] Patent Number: 5,775,984

[45] Date of Patent: Jul. 7, 1998

[54] REMOVABLE-RESUABLE FIBROUS SCRUBBING PAD FOR USE IN WET POWER ORBITAL SCUFFING APPLICATIONS

[76] Inventors: Jim C. Olson, 316 S. Rammer Rd., Arlington Heights, Ill. 60004; Leroy H. Rogers, 712 Dresser Rd., Mount Prospect, Ill. 60056

[21] Appl. No.: 693,682

[22] Filed: Aug. 12, 1996

Related U.S. Application Data

[63] Continuation-in-part of Ser. No. 311,266, Sep. 23, 1994, abandoned.

[51] Int. Cl.[6] ..... B24B 11/00

[52] U.S. Cl. ..... 451/536; 451/532; 451/533

[58] Field of Search ..... 451/532, 533, 451/539, 357, 536; 15/230.17, 230, 98

[56] References Cited

U.S. PATENT DOCUMENTS

| | | | |
|---|---|---|---|
| 1,217,593 | 2/1917 | Graft | 451/539 |
| 2,174,902 | 10/1939 | Stratford | 451/533 |
| 2,226,553 | 12/1940 | Cross | 451/533 |
| 2,414,474 | 1/1947 | March | 451/532 |
| 2,431,258 | 11/1947 | Kirchner | 451/532 |
| 2,492,143 | 12/1949 | Gipple et al. | 451/532 |
| 2,768,483 | 10/1956 | Hurst | 451/532 |
| 3,014,318 | 12/1961 | Manchester et al. | 15/230 |
| 3,147,575 | 9/1964 | Schnabel | 451/532 |
| 3,176,364 | 4/1965 | Dritz | 24/213 |
| 3,302,232 | 2/1967 | Wasiloff et al. | 15/230.17 |
| 3,703,739 | 11/1972 | Young et al. | 15/230.17 |
| 4,331,453 | 5/1982 | Dau et al. | 451/532 |
| 4,355,489 | 10/1982 | Heyer et al. | 451/532 |
| 4,715,150 | 12/1987 | Takeuchi et al. | 451/533 |
| 5,003,659 | 4/1991 | Paepke | 15/230.17 |
| 5,172,980 | 12/1992 | Provost | 383/204 |
| 5,185,964 | 2/1993 | Englund et al. | 451/532 |
| 5,201,785 | 4/1993 | Nagano | 451/538 |
| 5,383,309 | 1/1995 | Sampietro | 451/533 |

*Primary Examiner*—Eileen P. Morgan
*Attorney, Agent, or Firm*—Kajane McManus

[57] ABSTRACT

The fibrous scrubbing pad is proposed for use in wet orbital power scuffing of a damaged portion of a painted surface for enhancing paint color blending and adhesion during repair. It is particularly suited for use in auto collision repair. The pad most preferably incorporates three layers, a top layer comprising a sheet of loops mechanically engaged by a hooked surface of a power device disc pad used for driving the fibrous scrubbing pad, and a wet acid based scuffing medium impermeable layer of material engaging the sheet of loops to one surface of a fibrous pad layer used to scrub a wet acid based scuffing medium against the painted surface, to cause scuffing thereof.

10 Claims, 1 Drawing Sheet

REMOVABLE-RESUABLE FIBROUS SCRUBBING PAD FOR USE IN WET POWER ORBITAL SCUFFING APPLICATIONS

CROSS-REFERENCE TO RELATED APPLICATIONS

This application is a continuation-in-part of U.S. application Ser. No. 08/311,266 filed on Sep. 23, 1994, and entitled Fibrous Abrasive Pad for Power Wet Sanding, now abandoned.

BACKGROUND OF THE INVENTION

The present invention relates to a pad for use during wet power orbital scuffing of a painted surface which enhances color blending and adhesion during repair of a damaged portion of the surface. More particularly, the pad is proposed for use in the auto collision repair industry when technologically modern auto finishes demand use of a wet sanding medium to produce acceptable results.

PRIOR ART

Heretofore, wet scuffing of modern auto finishes has necessarily been done by hand. The process involves application of a layer of water and a wet acid based scuffing medium to an area of an auto body to be repainted and manually scrubbing the medium into the area with a small fibrous pad. Such process is very time consuming, and, with aerodynamic curves and/or stylistic curves predominating, the pad is hand manipulated to accommodate such curves while attempting to maintain even applied pressure.

Use of a palm and fingers in manipulation of such a pad causes complications. In this respect, and particularly with respect to metallic, mica and pearl paints as well as clear acrylic and urethane coatings, due to differences in pressure applied against the surface by the fingers and the spaces there between, the scuffed area may appear streaked without numerous rescuffings. Such streaks ruin modern paint applications and the clear coatings used today act to magnify each and every such small streak. Further, such blemishes may not even become evident until after the paint and clear coatings dry, at times requiring one or more complete repeat scuffing/painting operations to remove them.

Not only does such hand scuffing consume significant amounts of time; it also consumes significant amounts of the wet scuffing medium itself. In this respect, during the scuffing operation, the wet scuffing medium tends to infiltrate into and through the pads, exuding upwardly out between the fingers so that less and less medium is being manipulated with each stroke and at the same time affecting the friction between the pad and the hand and hence the ability of the hand to adequately engage the top of the pad and thereby control its use. Typically the pad has to be flipped over every few strokes to keep the greater amount of scuffing medium under the pad.

On the other hand, dry scuffing has become easier by use of a dual action, random orbital power scuffer and existing abrasive pads. However, no pad yet exists which can be operated with such powered orbital devices in a wet scuffing application without disintegrating when removed from the drive disc. Such disintegration not only makes dry scuffing pads practically useless in wet scuffing applications, but also ruins the disc pad of the power device by means of which it is driven as will be described below.

A known simple engagement for a power device uses a disc pad having hook members formed on the surface that contacts a sand paper sanding pad. The surface containing the hooks is commonly referred to as a "Hookit" surface. In such arrangement, the disc pad having a Hookit surface engages loops on a back side of the sanding pad.

Fibrous abrasive pads are generally not used with power driven disc pads inasmuch as wet applications degrade the fibrous pad to disintegration, the loose pad fibers becoming irremovably tangled in the Hookit surface, forming a fibrous ball thereon. Aside from the obvious expense resulting from the loss of the fibrous pad, interaction of the pad fibers with the Hookit surface also renders the disc pad unusable and such wet scuffing operation impractical.

Due to the great expenditures in time, labor and materials described, the cost for auto collision repair has significantly increased.

SUMMARY OF THE INVENTION

Accordingly it is a primary object of the invention to provide a reusable fibrous scrubbing pad which can be used efficiently and successfully in power driven orbital wet scuffing applications.

It is a further object to provide a pad which will not disintegrate onto a drive disc of a power device.

It is a further object to provide a pad which is easily engaged to and removed from the Hookit surface of the disc pad.

It is a further object to provide a pad which conserves the amount of the wet scuffing medium required during the operation.

It is a further object to provide a pad which is usable in scuffing curved surfaces due to pliability.

These and other objects are met by the wet fibrous scrubbing pad of the present invention which comprises a multi-layer member having a fibrous scrubbing layer, a wet acid based scuffing medium impermeable layer, with the scuffing medium impermeable layer, isolating the fibrous layer from contacting an engaging surface of a disc pad and engaging a disc pad engaging layer comprising loops of material which engage the hook surface of the disc pad in a releasable manner.

DESCRIPTION OF THE PREFERRED EMBODIMENT

Figure 1:
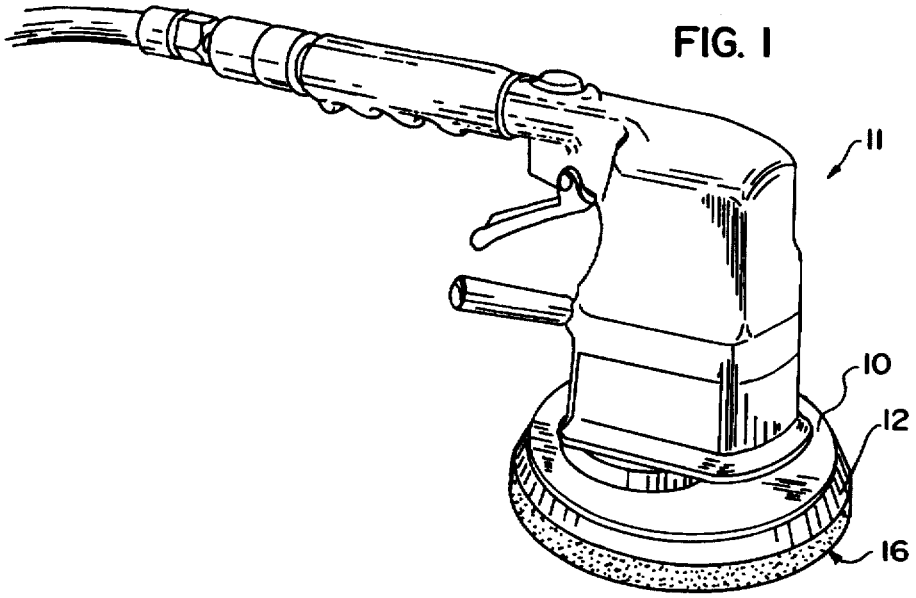
FIG. 1 shows a dual action random orbital power device having a disc pad for power driving of the scrubbing pad the present invention.
Figure 2:
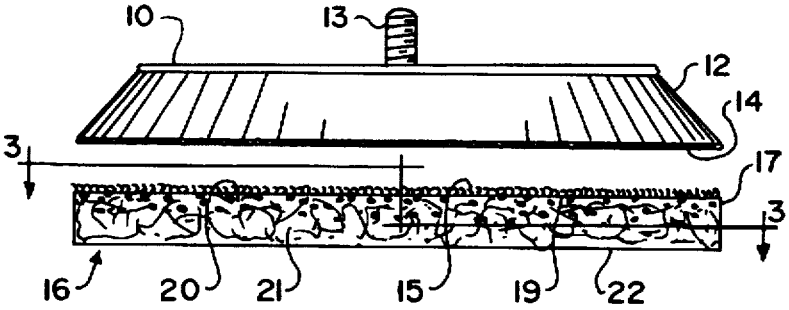
FIG. 2 is a side view showing the disc pad detached from the device and being engaged to/disengaged from the scrubbing pad of the present invention.
Figure 3:
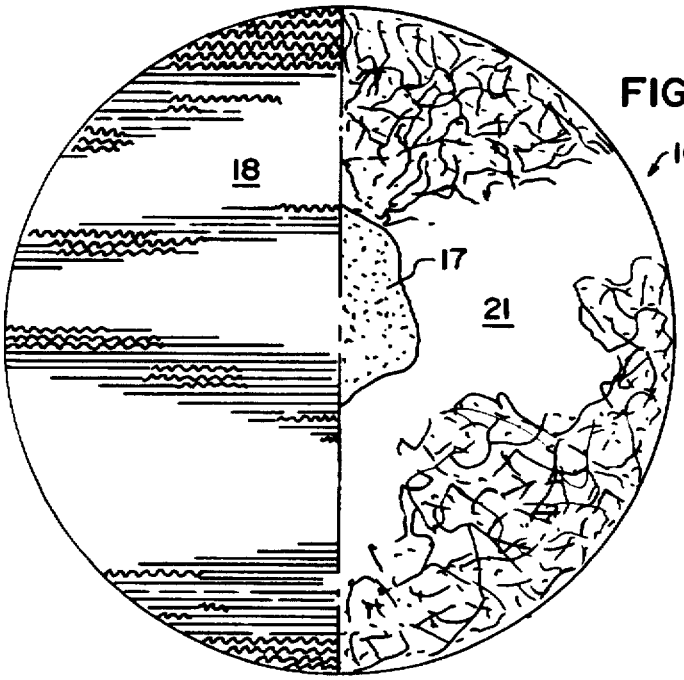
FIG. 3 is a cutaway plan view of the scrubbing pad of the present invention.

Referring now to the drawings in greater detail, there is illustrated therein a dual action random orbital power device 11. The device 11 includes a detachable disc pad 12 which is shown detached in FIG. 2.

A threaded stud 13 centrally extends from a top surface 10 of the disc pad 12 for rotatably securing the disc pad 12 to the device 11. A bottom surface 14 of disc pad 12 is covered with hook elements (not shown) of a mechanical engagement system similar to those used in "Velcro"™ releasable attachment systems.

The hooked bottom surface 14 of the disc pad 12 engages a cooperating top loop layer 15 of the fibrous scrubbing pad 16 of the present invention. The layer 15 of loop elements is provided in the form of a sheet 18. The individual elements of the loop layer 15 engage the individual hooks of the hooked bottom surface 14 of the disc pad 12 when the surface 14 and layer 15 are pressed together. The loop layer 15 is currently used as a backing for sheets of sand paper sold by the 3M Company for use with a sander 11 in dry sanding applications.

A layer 17 of wet scuffing medium impermeable material engages to and between a bottom looped surface 19 of the loop layer 15 and a top surface 20 of a fibrous pad 21. A suitable wet scuffing medium impermeable material layer 17 could be formed using as one of its components layer scuffing 3M Corporation's Superfast Urethane Adhesive No. 08609. The wet scuffing medium impermeable layer 17 not only prevents the wet scuffing medium from permeating through the fibrous pad 21 and wetting the loop layer 15 thereof as well as the hooked bottom surface 14 of the disc pad 12, but it also keeps the wet scuffing medium where it should be; against the surface being scuffed, thereby conserving the amount of the relatively expensive medium required during the scuffing procedure and further keeps the fibers of the fibrous pad 21 from becoming entangled in the hooked bottom surface 14 of the disc pad 12, rather than allowing the fibers to come apart and during disengagement from the disc pad 12 ruining usefulness of the hooked surface 14.

The fibrous pad 21 has a bottom surface 22 which provides a power driveable scrubbing surface 22 for the fibrous scrubbing pad 16. Fibrous pad 21 may be any type of fibrous pad 21 that will provide a desired degree of scrubbing action so the wet scuffed surface medium produces a sanded suitable to be finished. One pad of this type is readily available in sheets from the 3M Company under the name Scotch-Brite™ Conditioning Pad.

Formation of the pad 16 to have the structure described above provides a firm and flexible consistency to the pad 16, allowing same to accommodate scuffing of curved surfaces as well as of flat surfaces.

As stated above, in a preferred application, the fibrous scrubbing pad 16 is used in the scuffing of exterior automotive panels for improved adherence and paint color blending during refinishing. In a typical procedure, a surface to be scuffed is first water wetted, then a wet surface scuffing compound such as Glasurit™ Sand Fix is applied, with such acid based compound then being scrubbed into and over the area of the surface to be refinished. The fibrous scrubbing pad 16 of this invention permits the use of the orbital power device 11 to scuff the surface to be refinished using the wet scuffing medium as applied by the fibrous pad 21. Through experience, the capability of wet power scuffing produced by the fibrous scrubbing pad 16 of the present invention reduces preparation time by 40 to 60% and decreases wet scuffing medium consumption and costs by about 25 to 35% over wet hand scuffing, with such savings passing on to the consumer. In addition, the conservation of wet scuffing medium due to decreased infiltration thereof through the pad achieves further cost savings. Finally, the ability to employ orbital power wet-scuffing in an economical manner results in a more consistently effective and efficient refinishing procedure. It should be noted that the wet scuffing medium impermeable layer 17, in our experience, is most preferably one layer; however, it is anticipated that further experimentation may develop a wet scuffing medium impermeable layer 17 comprising two or more sub-layers of materials selected for their optimal combination of strength, impermeability and cost.

It will be understood that use of the pad 16 in auto collision repair is not the only arena within which the pad 16 could be proposed for use. However, the pad 16 does offer a solution in the collision repair industry to a long standing problem.

As described above, the fibrous scrubbing pad 16 of the present invention provides a number of advantages, some of which have been described above and others of which are inherent in the invention. Also, modifications to the fibrous scrubbing pad 16 may be proposed without departing from the teachings herein. Accordingly, the scope of the invention is only to be limited as necessitated by the accompanying claims.

We claim:

1. A reusable fibrous scrubbing pad for use in orbital power wet scuffing applications using a wet acid based scuffing medium, and a power driven (orbital) device having a disc pad which has a hooked scrubbing pad engaging surface, the scrubbing pad comprising:

a first layer of material defined as a sheet of loops which mechanically engages the hooked scrubbing pad engaging surface of the power device disc pad;

a second layer of material defined as a loosely woven fibrous pad for scrubbing the wet acid based scuffing medium against a surface to be scuffed: and a third layer of at least one firm and flexible material, the at least one material being defined as a wet acid based scuffing medium impermeable material, the third layer being formed between and in a manner engaging each of the first and second layers, to form an integral three layer power wet scrubbing pad for use in orbital applications.

2. The pad of claim 1 wherein said wet sanding medium impermeable layer defines a mechanical engagement means for bonding said first and second layers together.

3. The pad of claim 1 wherein said second layer comprises a pad of loosely interwoven fibers.

4. The pad of claim 3 wherein said fibers are prone to unweaving.

5. The pad of claim 4 wherein said wet sanding medium impermeable layer defines a mechanical means for maintaining fibers of the fibrous pad layer intact against potential unweaving.

6. The pad of claim 5 being configured for particular application to auto collision repair.

7. The pad of claim 3 wherein said loosely woven fibrous pad includes a scrubbing surface which extends entirely across the loop layer and is uninterrupted.

8. The pad of claim 7 being configured to accommodate scrubbing of flat and curved surfaces.

9. The pad of claim 1 wherein said third layer consists of two or more sub-layers selected for their optimal combination of strength, impermeability and material cost.

10. A fibrous scrubbing pad particularly configured for use with an orbital power device having a disc pad with a hooked surface for driving of a pad functionally engaged thereto, the scrubbing pad evenly scuffing a damaged auto surface by scrubbing a wet acid based abrasive medium applied to the auto surface against the auto surface, the scrubbing pad comprising:

a first layer of material defined as a sheet of loops which mechanically engages the hooked surface of the disc pad;

a second layer of material defined as a loosely woven fibrous pad for scrubbing the abrasive medium against a surface to be evenly scuffed; and a third layer of material defined as a firm and flexible layer of acid based abrasive medium impermeable material, the third layer being formed between and in a manner engaging each of the first and second layers, to form an integral three layer fibrous scrubbing pad wherein said second layer is kept from contacting the hooked surface of the disc pad by the third layer of material.

* * * * *